US006225041B1

(12) United States Patent
Takada

(10) Patent No.: US 6,225,041 B1
(45) **Date of Patent: *May 1, 2001**

(54) SILVER HALIDE PHOTOGRAPHIC EMULSION AND SILVER HALIDE PHOTOGRAPHIC LIGHT SENSITIVE MATERIAL

(75) Inventor: Hiroshi Takada, Hino (JP)

(73) Assignee: Konica Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/879,974

(22) Filed: Jun. 20, 1997

(30) Foreign Application Priority Data

Jun. 26, 1996 (JP) ..... 8-166040

(51) Int. Cl.[7] ..... G03C 1/005
(52) U.S. Cl. ..... 430/567; 430/569
(58) Field of Search ..... 430/637, 567, 430/569

(56) References Cited

U.S. PATENT DOCUMENTS 4,806,461 * 2/1989 Ikeda et al. ..... 430/567
5,147,772 * 9/1992 Tsaur et al. ..... 430/569
5,147,773 * 9/1992 Tsaur et al. ..... 430/569
5,210,013 * 5/1993 Tsaur et al. ..... 430/567
5,252,453 * 10/1993 Tsaur et al. ..... 430/569
5,418,124 * 5/1995 Suga et al. ..... 430/567
5,496,694 * 3/1996 Kikuchi et al. ..... 430/567
5,498,516 * 3/1996 Kikuchi et al. ..... 430/567

FOREIGN PATENT DOCUMENTS 0 562 476 A1 9/1993 (EP) ..... G03C/1/16
4-125630 4/1992 (JP) ..... G03C/1/035

* cited by examiner

*Primary Examiner*—Mark F. Huff
*Assistant Examiner*—Amanda C. Walke
(74) *Attorney, Agent, or Firm*—Frishauf, Holtz, Goodman, Langer & Chick, P.C.

(57) ABSTRACT

A silver halide photographic emulsion is disclosed, consisting essentially of tabular silver halide grains having an average aspect ratio of 3.0 or more, the tabular grains substantially having dislocation lines, a variation coefficient of grain size of said tabular grains being 20% or less and a variation coefficient of thickness of said tabular grains being 20% or less. There is also disclosed a photographic light sensitive material containing the tabular grains.

19 Claims, No Drawings

SILVER HALIDE PHOTOGRAPHIC EMULSION AND SILVER HALIDE PHOTOGRAPHIC LIGHT SENSITIVE MATERIAL

FIELD OF THE INVENTION

The present invention relates to a silver halide emulsion and a silver halide photographic light sensitive material, and in particular a silver halide emulsion which is superior in sensitivity and fog and improved in pressure resistance and storage stability, and a silver halide photographic light sensitive material by use thereof.

BACKGROUND OF THE INVENTION

Recently, demand for photographic performance of a silver halide photographic light sensitive material (hereinafter, referred to as photographic material) become severe. In particular, demands for not only basic performance such as high sensitivity, low fog and superior graininess but also other performance such as pressure resistance and storage stability become stronger than those in the past.

In general, silver halide photographic light sensitive materials are subject to a variety of pressure. A negative film, for example, is subject to pressure when being cut or perforated in the manufacturing process thereof, or bent or abraded when being transported in the camera. As well known in the art, when a variety of pressure are applied to the silver halide photographic material, changes in photographic performance are produced, and a technique for enhancing resistance to these pressure has been desired. Popularization of a compact camera and a film-built-in camera leads to daily photographing and spread of its use, so that silver halide photographic materials are held under various environments and used under various conditions. As a result, their storage stability become one of important performance items.

A dominant factor of basic photographic performance of the silver halide photographic light sensitive material concerns silver halide grains, and development of silver halide grains directed to enhancement of sensitivity and image quality has energetically been engaged so far. Generally speaking, it is effective for enhancement of image quality to make smaller the size of silver halide grains, leading to an increase of the number of grains per unit area and the number of color-developed points (i.e., number of image elements).

Making the grain size smaller, however, results in lowering of sensitivity so that it is limitative for satisfying both high sensitivity and high image quality. To achieve further higher sensitivity and higher image quality, there have been studied techniques of enhancing a ratio of sensitivity to size of the silver halide grain and as one of them, a technique of employing tabular silver halide grains are described in JP-A 58-111935 (herein, the expression, "JP-A" is referred to as unexamined and published Japanese Patent Application), 58-111936, 58-111937, 58-13927 and 59-99433.

As compared to regular crystal silver halide grains such as hexahedral grains, octahedral grains, or dodecahedral grains, the tabular silver halide grains each have larger surface area per grain so that, in the case of the same volume, the tabular grains can cause a larger amount of a spectral sensitizing dye to be adsorbed to the grain surface, advantageously leading to further sensitization. There are also disclosed a technique of providing a site with a high iodide content inside the tabular silver halide grain, as described in JP-A 63-92942 and a technique of employing hexagonal tabular silver halide grains, as described in 63-151618, each showing effects in sensitivity and graininess.

JP-A 63-106746 discloses the use of tabular silver halide grains having substantially a layered structure parallel to two major faces which are opposite with each other, and JP-A 1-279237 also discloses the use tabular silver halide grains having a layer structure divided by plane substantially parallel to two opposite major faces, in which the outermost layer thereof has a higher average iodide content by 1 mol % or more than an average overall iodide content of the grains. In addition, JP-A 1-183644 discloses a technique of using tabular silver halide grains in which iodide distribution in the iodide containing silver halide phase is completely uniform.

There are some reports concerning a technique in view of parallel twin planes of the tabular silver halide grains (hereinafter, sometimes referred to as tabular grains). For example, JP-A 63-163451 discloses a technique of using tabular grains having 5 or more of a ratio (b/a) of grain thickness (b) to a longest spacing between two or more parallel twin planes (a). JP-A 1-201649 discloses a technique of limiting the number of dislocation lines present in tabular silver halide grains, describing its effect on sensitivity, graininess and sharpness.

WO No.91/18320 (herein, the term, "WO" means published International Patent Application) discloses a technique of using tabular silver halide grains having a spacing between at least two twin planes of less than 0.012 mm, and JP-A 3-353043 discloses a technique of using core/shell type tabular silver halide grains having an average longest twin plane spacing of 10 to 100 Å, each disclosure describing improvements in sensitivity and graininess, or sharpness, pressure characteristics and graininess, respectively.

A technique which is regarded, in the art, as one of the most basic and important techniques in the process of studying of silver halide emulsions for the purpose of enhancing sensitivity and image quality of a silver halide photographic light sensitive material is one of making silver halide emulsion grains monodisperse. Since an optimal condition for chemical sensitization is different between large-sized grains and those with small-sized ones, it is hard to subject a silver halide emulsion which is comprised of both grains, i.e., polydispersed (broad in grain size distribution), to optimal chemical sensitization, often resulting in an increase of fog and insufficient chemical sensitization. In the case of a monodispersed silver halide emulsion, on the other hand, it is easy to subject the emulsion to optimal chemical sensitization, enabling to prepare the silver halide emulsion with high sensitivity and low fog. Furthermore, it is possible to expect a characteristic curve with a high contrast (high gamma).

With regard to a technique of making tabular silver halide grains monodisperse, JP-A disclosed a technique of improving sensitivity and graininess with monodisperse tabular silver halide grains with two parallel twin planes. JP-A 5-173268 and 6-202258 disclose preparation of tabular silver halide grains with narrow grain size distribution. In these techniques of making the tabular grains monodisperse, the monodisperse tabular grains are referred to as those with a narrow distribution with respect to the grain projected area. Further, JP-A 6-258744 discloses improvements in sensitivity, contrast, pressure resistance and latent image stability by use of monodisperse tabular silver halide grains internally having region different in halide composition. Herein, the expression, "monodisperse" means narrow distribution with respect to the volume of the grains. Thus, these conventional techniques concerning monodisperse tabular silver halide grains are to note the projected are diameter and the variation coefficient of grain volume alone, and are not a technique with intent to control a variation coefficient of grain thickness.

With regard to a technique thickness of the tabular silver halide grains, there have been known techniques described in JP-A 6-43605, 6-43606 and 7-191425. More concretely, a technique disclosed in JP-A 6-43605 or 6-43606 is to note an average value of thickness of the tabular silver halide grains and a technique disclosed in JP-A 7-191425 concerns limitation with respect to a ratio of a variation coefficient of grain thickness to a variation coefficient of twin plane spacing.

With respect to making narrow thickness distribution of the tabular grains, the above JP-A 6-43605, 6-43606 and 7-191425 suggest its usefulness in photographic performance and emulsion preparation, but teach no technique for embodiment thereof.

JP-A 173272 discloses a silver halide emulsion comprised of hexagonal tabular silver halide grains having even-numbered twin planes parallel to the major face and a maximum adjacent edge ratio of 2.0 to 1.0, a variation coefficient of grain size being in a range of 21 to 29% and that of grain thickness, 20% or less. In Examples of the disclosure is cited, as a comparative example, a silver halide emulsion containing tabular grains with a variation coefficient of diameter of 20% or less and a variation coefficient of grain thickness of 20% or less. However, these variation coefficients of the emulsion are values measured with respect to hexagonal tabular silver halide grains having a maximum adjacent edge ratio of 2.0 to 1.0. It was proved through the inventor's following this example that hexagonal tabular silver halide grains having major faces with a maximum adjacent edge ratio of 2.0 to 1.0 accounted for about 90% or less of the grain projected area, and further thereto, small grains which appeared to be regular crystals and coarse grains having a plurality of non-parallel twin planes are also present in the emulsion. As a result of measurements of grain diameter and thickness with respect to any grains contained in the emulsion, it was proved that variation coefficients thereof both exceeded 20%.

As a method for enhancing sensitivity of a silver halide emulsion, U.S. Pat. No. 4,956,269 discloses a technique of introducing dislocation lines into tabular silver halide grains. As is generally known, application of pressure to silver halide grains results in fog or desensitization. In particular, silver halide grains into which dislocation lines are introduced have such a problem that, when subjected to pressure, marked desensitization occurs. JP-A discloses a silver halide emulsion, in which at least 50% by number of total tabular grains is accounted for tabular grains having an aspect ratio of 8 or more a ratio (b/a) of grain thickness (b) to a longest spacing between two or more, parallel twin planes (a) of 5 or more, and at least 50% by number of total tabular grains is accounted for by grains having dislocation lines of 10 or more. The disclosure further describes a preferred embodiment in which a variation coefficient of grain thickness is 30% or less and a variation coefficient of projected area is 20% or less.

As a result of the study by the inventor, however, it was shown that the emulsion obtained according to the above disclosure contained, besides the tabular grains, another type of silver halide grains, such as regular crystal grains and non-parallel tabular grains. It was further shown that a variation coefficient of grain size of the obtained emulsion was more than 20%. Thus, the emulsions obtained according to the above disclosure were distinct from emulsions according to the present invention, as described below.

However, a silver halide emulsion having such a feature is not concretely described in the disclosure, and marked pressure desensitization due to introduced dislocation lines has not been improved through the technique taught by the disclosure. JP-A 3-189642 discloses a silver halide emulsion containing tabular silver halide grains having an aspect ratio of 2 or more and dislocation lines of 10 or more in the fringe portion of the grain, the tabular silver halide grains being monodisperse with respect to size distribution. The disclosure, however, is silent with respect to grain thickness distribution.

It is, for example, effective in decreasing the variation coefficient of grain thickness to retard the grain growth in the direction of the grain thickness, through the course of nucleation and growth. More concretely, there are a method in which grain growth in the direct parallel to the major face is accelerated by causing the grain to form at a low pBr, resulting in retardation of the growth in the direction of grain thickness; and a method in which the grain growth in the direction of the grain thickness is retarded by restraining super-saturation during the course of the grain growth. In these methods, however, it was proved that an aspect ratio of the resulting tabular grains increased, resulting in marked increase of the variation coefficient of grain size.

Thus, there has not been obtained a silver halide emulsion containing tabular silver halide grains relating to the present invention, the tabular grains having dislocation lines and variation coefficients of grain size and grain thickness both being smaller. In addition thereto, it has not been known that pressure desensitization of the silver halide grains having dislocation lines can be improved by use of the silver halide emulsion.

SUMMARY OF THE INVENTION

It is an objective of the present invention to provide a silver halide emulsion superior in fog and sensitivity, little in fog-increase and sensitivity-decrease during storage and improved in pressure resistance, and a silver halide photographic light sensitive material by use thereof.

The above objective can be accomplished by the following constitutions.

1. A silver halide photographic emulsion, characterized in that the silver halide emulsion contains tabular silver halide grains having an average aspect ratio of 3.0 or more, said tabular grains substantially having dislocation lines, a variation coefficient of grain size being 20% or less and a variation coefficient of thickness being 20% or less.

2. The silver halide photographic emulsion described in 1, characterized in that the average aspect ratio of said tabular silver halide grains is 6.0 or more.

3. The silver halide photographic emulsion described in 1 and 2, characterized in that the variation coefficient of thickness of the silver halide grains is 15% or less.

4. A silver halide photographic light sensitive material, characterized in that said silver halide photographic light sensitive material comprises a support provided thereon a silver halide emulsion layer comprising the silver halide emulsion described in 1 through 3.

DETAILED DESCRIPTION OF THE INVENTION

In general, tabular silver halide grains are crystallographically classified into twin crystal. The twin Crystal is referred to as a crystal internally having at least one twin plane. The classification of the twin crystal configuration are detailed in, for example, Klein and Moisar, Photographishe korrespondenz, vol.99, page 99 and ibid, vol.100, page 57.

The tabular silver halide grains according to the invention are referred to as ones having one or at least two parallel twin planes with the grain. To reduce distribution of grain size and thickness among grains, grains having two parallel twin planes are preferred.

In the invention, the aspect ratio is referred to as a ratio of grain size to grain thickness (aspect ratio=diameter/thickness). The grain size is defined as a diameter of a circle identical to the projected area in the case when the grain is projected in the direction vertical to the surface having a largest area (referred to as a major face). The grain thickness of a tabular grain is defined as a thickness in the direction vertical to the major face and identical to a distance between two major faces.

The grain size and thickness can be determined in accordance with the following method. There is prepared a sample in which silver halide grains are coated on a support so that the major face of the silver halide grains are oriented in parallel to that of latex balls used as internal standard and having a known diameter. After being subjected to shadowing from a give angle by a carbon evaporating method, a replica sample is prepared by a conventional replica method. Electronmicrograph of the sample is taken and the projected area and thickness of each grain can be determined using a device such as an image processor. In this case, the projected area of the grain can be determined from that of the internal standard, and the thickness of the grain can be determined from shadow lengths of the internal standard and the grain.

In the invention, the average value of the aspect ratio, grain size and grain thickness is referred to as an arithmetic average value thereof obtained by measuring at random 1000 or more silver halide grains contained in the emulsion by the shadowing method. An average aspect ratio of the tabular silver halide grains according to the invention is 3.0 or more and preferably 6.0 or more.

The variation coefficient of grain size or thickness of silver halide grains is defined according to the following equations, using values obtained from the above-described measurement. The variation coefficient of grain size of the silver halide grains according to the invention is 20.0% or less and preferably 10% or less. The variation coefficient of grain thickness of the silver halide grains according to the invention is 20% or less and preferably 15% or less.

Variation coefficient of grain size (%)=(standard deviation of grain size/average grain size)×100

Variation coefficient of grain thickness (%)=(standard deviation of grain thickness/average thickness)×100

With regard to halide composition of the silver halide grains according to the invention, silver iodobromide or silver iodochlorobromide is preferred. Silver iodobromide containing 1.0 mol % or more iodide is particularly preferred. The average iodide content of the silver halide emulsion according to the invention is preferably 10 mol % or less and more preferably 1.0 to 6.0 mol %. The composition can be determined by a composition analyzing method such as EPMA method or X-ray diffraction analysis.

The average iodide content of the surface phase of the silver halide grains according to the invention is preferably 1 mol % or more, more preferably, 2 to 20 mol % and further more preferably, 3 to 15 mol %. The average iodide content of the surface phase of the silver halide grains is one obtained by XPS method or ISS method. The surface iodide content is obtained, for example, by the XPS method, according to the following manner. A sample is cooled down to −155° C. or lower under ultra-high vacuum of $1\times10^{-4}$ torr or less ,exposed to MgK α line serving as a probing X-ray generated at a X-ray source current of 40 mA and measured with respect to Ag3d5/2, Br3d and I3d3/2 electrons. The measured integral strength of the peak is corrected by a sensitivity factor and the resulting strength ratios, the halide composition can be determined.

The silver halide grains according to the invention substantially have dislocation lines. The expression, "substantially have dislocation lines" means that, when any 1,000 or more silver halide grains contained in the emulsion are observed, at least 50% of the total grain projected area is accounted for by grains having dislocation lines. The site of the dislocation lines being present is especially non-limitative. The dislocation lines are present preferably in the vicinity of the outer periphery, in the vicinity of the edge or in the vicinity of the corner of the tabular silver halide grains. As to the time of introducing the dislocation lines into the grain, it is preferred to introduce the dislocation line after 50% of the overall silver amount of the grains is introduced, more preferably during 60 to 95% and furthermore preferably, during 70 to 90%. As to the number of the dislocation lines, grains having 5 or more dislocation lines preferably account for 50% or more, more preferably 70% or more and furthermore preferably 90% or more of the total grain projected area. In each case, the number of the dislocation lines is more preferably 10 or more.

The dislocation lines in the silver halide grains can be directly observed by means of transmission electron microscopy at a low temperature, for example, in accordance with a method described in J. F. Hamilton, Photo. Sci. Eng. vol.11 (1967) 57 and T. Shiozawa, Journal of the Society of Photographic Science and Technology of Japan, vol.35 (1972) 213. Silver halide grains are taken out from a silver halide emulsion while making sure not to exert any pressure that causes dislocation in the grain, and they are place on a mesh for electron microscopy. The sample is observed by transmission electron microscopy, while being cooled to prevent the grain from being damaged (e.g., printed-out) by electron beam. Since electron beam penetration is hampered as the grain thickness increases, sharper observations are obtained when using an electron microscope of high voltage type (e.g., over 200 KV for 0.25 μm thick grains). From the thus-obtained electronmicrograph, the position and number of the dislocation lines in each grain can be determined in the case when being viewed from the direction perpendicular to the major face.

In the silver halide emulsion according to the invention, iodide content distribution among the silver halide grains preferably is more uniform. Thus, a variation coefficient of the iodide content of the silver halide emulsion is preferably 30% or less and more preferably 20% or less. The variation coefficient of the iodide content is a standard deviation of the iodide content divided by an average iodide content and multiplied by 100, which can be determined by measuring 1,000 or more silver halide grains contained in the silver halide emulsion.

In general silver halide photographic grains are microcrystals comprised of silver chloride, silver bromide, silver iodide or solid solution thereof, being able to form two or more phases different in halide composition within the crystal. Silver halide grains having such a structure are known as grains comprised of an inner nucleus phase and outer surface phase which have each different halide composition, and generally called core/shell type grains. The silver halide grains used in the invention preferably have the core/shell type structure in which the outer surface phase has a higher iodide content than that of the inner nucleus phase.

As to the mode of preparing a silver halide emulsion in the invention, any method known in the art is applicable, including a controlled double jet method and controlled triple jet method in which the pAg of a reaction mixture is controlled during formation of silver halide grains. Silver halide solvents can optionally be used. Examples of useful silver halide solvents include ammonia, thioethers and thioureas. Thioethers are referred to U.S. Pat. Nos. 3,271,157, 3,790,387, and 3,574,628. Preparation method of the silver halide grains according to the invention are not specifically limitative, and any method such as an ammoniacal method, neutral method or acid method is applicable. It is preferred to prepare the tabular silver halide grains under environment at a pH of 5.5 or less (more preferably, 4.5 or less) in terms of preventing fogging during formation of silver halide grains.

It is preferred that to precisely control the iodide content among silver halide grains or within the grain, at least one part of forming an iodide containing phase of the silver halide grains is carried out in the presence of silver halide grains having lower solubility than that of the silver halide grains. As the silver halide grains having lower solubility is preferably silver iodide. It is also preferred to conduct at least one part of forming the iodide containing phase by supplying one or more fine halide grains.

Any method of introducing the dislocation lines into the silver halide grain is applicable. The dislocation lines can be introduced by a variety of methods, in which, at a desired position of introducing the dislocation lines during the course of forming silver halide grains, an iodide (e.g., potassium iodide) aqueous solution is added, along with a silver salt (e.g., silver nitrate) solution and without addition of a halide other than iodide by a double jet technique, fine silver iodide grains are added, only an iodide solution is added, or a compound capable of releasing an iodide ion, as disclosed in JP-A 6-11781 is employed. Of these, it is preferred to add iodide and silver salt solutions by double jet technique, or to add fine silver iodide grains or an iodide ion-releasing compound, as an iodide source. It is more preferred to add the fine silver iodide grains.

A volume-converted diameter of the silver halide grains according to the invention is preferably 0.1 to 1.2 $\mu$m and more preferably 0.2 to 0.8 $\mu$m. In the case of less than 0.1 $\mu$m it is difficult to obtain sufficient sensitivity for practical use; on the other hand, in the case of more than 1.2 $\mu$m, graininess is markedly deteriorated due to the large grain size. The volume-converted diameter is referred to as an edge length of a cube having the same volume as a silver halide grain.

The tabular silver halide grains are generally prepared through the process of nucleation, ripening and growth. To make small the variation coefficients of grain size and thickness, it is crux to take into consideration of controlling each value thereof at the nucleation step and ripening step.

A method of preparing the silver halide emulsion according to the invention will be described below.

1. Nucleation

Nucleation of the tabular silver halide grain emulsion is conducted by double jet addition in which a silver salt aqueous solution and halide aqueous solution are simultaneously added to a reaction vessel containing an aqueous dispersing medium solution containing a protective colloid in general, or a single jet addition in which the silver salt solution is added to the protective colloid solution containing an alkali halide or contrarily, an alkali halide aqueous solution is added to the protective colloid solution containing the silver salt. Nucleation can optionally be conducted by a method described in JP-A 2-44335 and U.S. Pat. No. 5,104,786. Nucleation is preferably carried out in the protective colloid solution under the condition of pBr of 1 to 4. The pBr during nucleation is preferably 2.5 or less and more preferably 1.5 to 2.5.

Examples of the dispersing medium containing the protective colloid used during nucleation include gelatin and protective colloidal polymer. As the gelatin is conventionally employed alkali-processed gelatin having a molecular weight of 100,000 or so, and a low molecular weight gelatin (molecular weight: 5,000 to 30,000) and acid-processed gelatin are also employed. The dispersing medium preferably used in nucleation of the silver halide emulsion according to the invention is a gelatin having a low content of methionine which is considered to retard growth of the side-face of the tabular grains (i.e., growth in the direction parallel to the major face of the tabular grains). Examples thereof include acid-processed gelatin and oxidation-treated low molecular weight gelatin (molecular weight: 5,000 to 20,000). A concentration of the dispersing medium in the protective colloid solution used during nucleation is 5% by weight or less, based on the weight of the protective colloid solution, preferably 1% by weight or less and more preferably 0.5% or less. The temperature during nucleation is preferably 60° C. or lower, more preferably 5 to 50k C and furthermore preferably 10 to 40° C.

2. Ripening

A mixture of grains capable of growing as a tabular grain (grains having a single twin plane or grain having plural twin planes) and other grains (e.g., regular crystal grains, grains having non-parallel twin planes) is present at the time of completion the nucleation. To obtain highly monodisperse tabular silver halide grains, it is important to disappear grains other than grains with two parallel twin planes (in other words, parallel double-twinned grains) and make narrow the distribution of grain size and grain thickness. As a method enabling this is known nucleation, followed by Ostwald ripening. The Ostwald ripening is conducted by a technique of increasing a solution temperature, a technique of adding a silver halide solvent such as ammonia or thioether, or a technique of a combination of temperature increasing and solvent addition.

It is preferred to conduct Ostwald ripening without the use of the silver halide solvent to obtain the silver halide emulsion according of the invention. Addition of the solvent cause the thickness of the parallel double-twinned grains to increase, simultaneously deteriorating its distribution. The solution temperature during ripening is preferably 40 to 80° C. and more preferably 50 to 70° C. The pBr is preferably 1.0 to 3.0 and more preferably 1.5 to 2.5. The concentration of the dispersing medium is preferably 0.5 to 10% and more preferably 0.5 to 5% by weight.

To obtain the silver halide emulsion of the invention, it is preferred to add a compound represented by the following formula (I) immediately after completing nucleation.

$$YO(CH_2CH_2O)m(CH(CH_3)CH_2O)p(CH_2CH_2O)nY \qquad \text{Formula (I)}$$

In the formula, Y represents a hydrogen atom, —$SO_3M$ or —COBCOOM, in which M represents a hydrogen atom, an alkali metal atom, an ammonium group or ammonium group substituted by an alkyl group having 5 or less carbon atoms; B represents a chained or cyclic linkage group; n and m are each an integer of 0 to 50; p is an integer of 1 to 100. Exemplary examples of compounds represented by formula (I) are shown below.

I-1

$$HO(CH_2CH_2O)_m(\overset{\overset{\displaystyle CH_3}{|}}{C}HCH_2O)_{19.8}(CH_2CH_2O)_nH \qquad m + n = 9.77$$

I-2

$$NaO_2C(CH_2)OCO(CH_2CH_2O)_m(\overset{\overset{\displaystyle CH_3}{|}}{C}HCH_2O)_{17}(CH_2CH_2O)_nCO(CH_2)_2CO_2Na$$

(m + n = 5.7)

I-3

$$KO_2CCH{=}CHCOO(CH_2CH_2O)_m(\overset{\overset{\displaystyle CH_3}{|}}{C}HCH_2O)_{34.2}(CH_2CH_2O)_nCOCH{=}CHCO_2K$$

(m + n = 8.5)

I-4

$$NaO_3SO(\overset{\overset{\displaystyle CH_3}{|}}{C}HCH_2O)_{17}SO_3Na$$

I-5

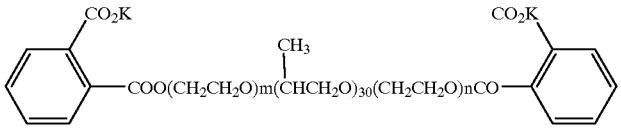

(m + n = 12)

I-6

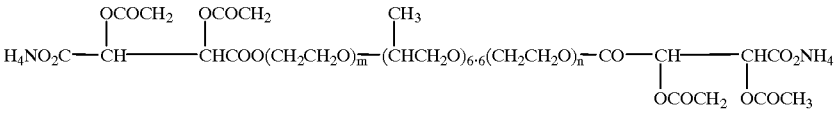

(m + n = 2.2)

In place of the above compounds are usable other polyalkyleneoxide block copolymers and hydrophilic polyalkyleneoxide or polyethyleneoxide derivatives, as described in U.S. Pat. Nos. 5,147,771, 5,147,772, 5,147,773 and 5,171,659 and JP-A 6-332090.

According to the disclosure described above, the above compound is contained from the time of nucleation. It is intended to prevent the size distribution of tabular nucleus grains from broaden and increase the nucleation number by retarding growth of tabular nucleus grains in the direction parallel to the major face thereof.

The presence of the compound from the step of nucleation is useful in making monodisperse size of the tabular nucleus grains. On the other hand, however, the compound cause the grain thickness distribution to broaden so that it cannot be a means useful for making monodisperse grain thickness. It is highly difficult to make narrow the grain thickness distribution which has been broadened at the stage of nucleation, in the subsequent ripening or growing process. Contrary to that, even if the grain size distribution is broadened to some extent after completing nucleation, it is possible to modify the grain size distribution by making the above-described compound present at the stage of ripening or growth. The crux of the preparation of the silver halide emulsion according to the invention is that:

1. nucleation is carried out without use of such a compound or protective colloidal material as to retard the tabular grain growth in the direction parallel to the major face;
2. ripening is carried out without use of such a solvent as to increase grain thickness; and
3. ripening and growth is carried out using the compound described above to optimally control broadening of the size distribution of the tabular grains.

Thus, the variation coefficient of thickness of the tabular silver halide grains is controlled at the stage of nucleation and ripening, and the variation coefficient of grain size is controlled at the stage of ripening and growth, whereby the silver halide emulsion according to the invention can be prepared.

Techniques described in Research Disclosure No. 308119 (hereinafter, denoted such as RD 308119) are applicable to the silver halide emulsion according to the invention, as shown below.

| Item | RD 308119 |
|---|---|
| Iodide | 993, I-A |
| Preparing method | 993, I-A; 994, I-E |
| Crystal habit (regular crystal) | 993, I-A |
| Crystal habit (twinned crystal) | 993, I-A |
| Epitaxial | 993, I-A |
| Halide composition (uniform) | 993, I-B |
| Halide composition (nonunuform) | 993, I-B |
| Halide conversion | 993, I-C |
| Halide substitution | 993, I-C |
| Metal doping | 993, I-D |
| Monodispersion | 993, I-F |
| Solvent addition | 993, I-F |
| Latent image forming site (surface) | 993, I-G |
| Latent image forming site (internal) | 993, I-G |
| Photographic material (negative) | 993, I-H |
| Photographic material (positive) | 993, I-H |
| Emulsion blending | 993, I-J |
| Desalting | 993, II-A |

The silver halide emulsion according to the invention is subjected to physical ripening, chemical ripening and spectral sensitization. As additives used in these processes are shown compounds described in Research Disclosure No. 17643, No. 18716 and No. 308119 (hereinafter, denoted as RD 17643, RD 18716 and RD 308119), as below.

| Item | RD 308119 | RD 17643 | RD 18716 |
|---|---|---|---|
| Chemical Sensitizer | 996, III-A | 23 | 648 |
| Spectral Sensitizer | 996, IV-A-A, B, C, D, H, I, J | 23-24 | 648-9 |
| Super Sensitizer | 996, IV-A-E | 23-24 | 648-9 |
| Anti-Foggant | 998, IV | 24-25 | 649 |
| Stabilizer | 998, IV | 24-25 | 649 |

Photographic additives usable in the invention are also described, as below.

| Item | RD 308119 | RD 17643 | RD 18716 |
|---|---|---|---|
| Anti-staining agent | 1002, VII-I | 25 | 650 |
| Dye Image-Stabilizer | 1001, VII-J | 25 | |
| Whitening Agent | 998, V | 24 | |
| U. V. Absorbent | 1003, VIII-C, XIIIC | 25-26 | |
| Light Absorbent | 1003, VIII | 25-26 | |
| light-Scattering Agent | 1003, VIII | | |
| Filter Dye | 1003, VIII | | |
| Binder | 1003, IX | 26 | 651 |
| Anti-Static Agent | 1006, XIII | 27 | 650 |
| Hardener | 1004, X | 26 | 651 |
| Plasticizer | 1006, XII | 27 | 650 |
| Lubricating Agent | 1006, XII | 27 | 650 |
| Surfactant, Coating aid | 1005, XI | 26-27 | 650 |
| Matting Agent | 1007, XVI | | |
| Developing Agent | 1011, XXB | | |

A variety of couplers can be employed in the invention and examples thereof are described in research Disclosures described above. Relevant description portions are shown below.

| Item | RD 308119 | RD 17643 |
|---|---|---|
| Yellow coupler | 1001, VII-D | 25, VII-C~G |
| Magenta coupler | 1001, VII-D | 25, VII-C~G |
| Cyan coupler | 1001, VII-D | 25, VII-C~G |
| Colored coupler | 1002, VII-G | 25, VII-G |
| DIR coupler | 1001, VII-F | 25, VII-F |
| BAR coupler | 1002, VII-F | |
| PUG releasing coupler | 1001, VII-F | |
| Alkali-soluble coupler | 1001, VII-E | |

Additives used in the invention can be added by dispersing methods described in RD 308119 XIV. In the invention are employed supports described in RD 17643, page 28; RD 18716, page 647–648; and RD 308119 XIX. In the photographic material according to the invention, there can be provided auxiliary layers such as a filter layer and interlayer, as described in RD 308119 VII-K, and arranged a variety of layer orders such as normal layer order, reverse layer order and unit layer arrangement.

The present invention is applicable to a variety of color photographic materials, such as color negative films, color paper, color positive films, and color reversal paper.

The photographic materials according to the invention can be processed in accordance with a convention method, as described in RD 17643, page 28–29, RD 18716, page 647, and RD 308119 XIX.

EXAMPLES

The present invention will be further explained based on the following examples, but embodiments of the invention are by no means limited to these.

Preparation of Comparative Emulsion Em-100

Nucleation

A gelatin solution (B-101) as shown below was maintained at a temperature of 28° C. with stirring by mixing stirrer described in JP-A 62-160128 at a rotating speed of 450 r.p.m. and the pH was adjusted to 1.95 using 1N sulfuric acid aqueous solution. Thereto were added solutions S-101 and X-101 by double jet addition at a constant flow rate over a period of 1 min. to form nucleus grains.

| | |
|---|---|
| B-101 | |
| Oxidized gelatin (av. M.W. 100.000) | 2.100 g |
| Potassium bromide | 0.932 g |
| Compound A (10 wt. % methanol solution) | 2.312 ml |
| $H_2O$ | 837.5 ml |
| Compound A $HO(CH_2CH_2O)m(CH(CH_3)CH_2O)_{19.8}(CH_2CH_2O)nH$ | (m + n = 9.77) |
| S-101 | |
| Silver nitrate | 1.624 g |
| $H_2O$ | 18.747 ml |
| X-101 | |
| Potassium bromide | 1.138 g |
| $H_2O$ | 18.708 ml |

Ripening

After completing addition, a solution G-101 was added thereto and the temperature was raised to 60° C. taking 30 min. The reaction mixture was further held over a period of 20 min., while a silver potential (measured with a silver ion selection electrode with reference to a saturated silver-silver chloride electrode) was controlled to 6 mV using 0.5N potassium bromide solution.

| | |
|---|---|
| G-101 | |
| Alkali-processed inert gelatin (MW 100,000) | 4.478 g |
| $H_2O$ | 105.4 ml |

Growth

After completing ripening, the pH was adjusted to 5.8 using 1N potassium hydroxide solution. Subsequently, solutions S-102 and X-102 were added by double jet addition at an accelerating rate (10 times from start to finish) over a period of 41 min. After completing addition, solution G-102 was added and then solutions S-103 and X-103 were added by double jet addition at an accelerating rate (8.7 times from start to finish) over a period of 121 min., while the silver potential of the reaction mixture was controlled to 8 mV using 1.0N potassium bromide solution.

| | |
|---|---|
| S-102 | |
| Silver nitrate | 20.60 g |
| $H_2O$ | 92.27 ml |
| X-102 | |
| Potassium bromide | 14.43 g |
| $H_2O$ | 91.77 ml |
| G-102 | |
| Alkali-processed inert gelatin (MW 100,000) | 20.76 g |
| $H_2O$ | 170.7 ml |

-continued

| | |
|---|---|
| S-103 | |
| Silver nitrate | 577.8 g |
| $H_2O$ | 834.0 ml |
| X-103 | |
| Potassium bromide | 396.7 g |
| Potassium iodide | 11.29 g |
| $H_2O$ | 824.2 ml |

After completing growth the reaction mixture was desalted to remove soluble salts according to the conventional manner, gelatin was further added thereto to redisperse and the pH and pAg were adjusted to 5.8 and 8.1, respectively. The resulting emulsion was referred to Em-100.

Preparation of Comparative Emulsion Em-200

Nucleation

A gelatin solution (B-201) as shown below was maintained at a temperature of 28° C. with stirring by mixing stirrer described in JP-A 62-160128 at a rotating speed of 450 r.p.m. and the pH was adjusted to 1.95 using 1N sulfuric acid aqueous solution. Thereto were added solutions S-201 and X-201 by double jet addition at a constant flow rate over a period of 1 min. to form nucleus grains.

| | |
|---|---|
| B-201 | |
| Oxidized gelatin (av. M.W. 100.000) | 2.100 g |
| Potassium bromide | 0.932 g |
| $H_2O$ | 839.9 ml |
| S-201 | |
| Silver nitrate | 1.624 g |
| $H_2O$ | 18.747 ml |
| X-201 | |
| Potassium bromide | 1.138 g |
| $H_2O$ | 18.708 ml |

Ripening

After completing addition, a solution G-201 was added thereto and the temperature was raised to 60° C. taking 30 min. The reaction mixture was further held over a period of 20 min., while a silver potential was controlled to 6 mV using 0.5N potassium bromide solution.

| | |
|---|---|
| G-201 | |
| Alkali-processed inert gelatin (MW 100,000) | 4.478 g |
| Compound A (10 wt. % methanol solution) | 2.312 ml |
| $H_2O$ | 103.0 ml |

Growth

After completing ripening, the pH was adjusted to 5.8 using 1N potassium hydroxide solution. Subsequently, solutions S-202 and X-202 were added by double jet addition at an accelerating rate (10 times from start to finish) over a period of 41 min. After completing addition, solution G-202 was added and then solutions S-203 and X-203 were added by double jet addition at an accelerating rate (8.7 times from start to finish) over a period of 121 min., while the silver potential of the reaction mixture was controlled to 8 mV using 1.0N potassium bromide solution.

| | |
|---|---|
| S-202 | |
| Silver nitrate | 20.60 g |
| $H_2O$ | 92.27 ml |
| X-202 | |
| Potassium bromide | 14.43 g |
| $H_2O$ | 91.77 ml |
| G-202 | |
| Alkali-processed inert gelatin (MW 100,000) | 20.76 g |
| $H_2O$ | 170.7 ml |
| S-203 | |
| Silver nitrate | 577.8 g |
| $H_2O$ | 834.0 ml |
| X-203 | |
| Potassium bromide | 396.7 g |
| Potassium iodide | 11.29 g |
| $H_2O$ | 824.2 ml |

After completing growth. the reaction mixture was desalted to remove soluble salts according to the conventional manner, gelatin was further added thereto to redisperse and the pH and pAg were adjusted to 5.8 and 8.1, respectively. The resulting emulsion was referred to Em-200.

Preparation of Comparative Emulsion Em-300

Nucleation

A gelatin solution (B-301) as shown below was maintained at a temperature of 28° C. with stirring by mixing stirrer described in JP-A 62-160128 at a rotating speed of 450 r.p.m. and the pH was adjusted to 1.95 using 1N sulfuric acid aqueous solution. Thereto were added solutions S-301 and X-301 by double jet addition at a constant flow rate over a period of 1 min. to form nucleus grains.

| | |
|---|---|
| B-301 | |
| Oxidized gelatin (av. M.W. 100.000) | 2.100 g |
| Potassium bromide | 0.932 g |
| Compound A (10 wt. % methanol solution) | 2.312 ml |
| $H_2O$ | 837.5 ml |
| S-301 | |
| Silver nitrate | 1.624 g |
| $H_2O$ | 18.747 ml |
| X-301 | |
| Potassium bromide | 1.138 g |
| $H_2O$ | 18.708 ml |

Ripening

After completing addition, a solution G-301 was added thereto and the temperature was raised to 60° C. taking 30 min. The reaction mixture was further held over a period of 20 min., while a silver potential was controlled to 6 mV using 0.5N potassium bromide solution.

| | |
|---|---|
| G-301 | |
| Alkali-processed inert gelatin (MW 100,000) | 4.478 g |
| $H_2O$ | 105.4 ml |

Growth

After completing ripening, the pH was adjusted to 5.8 using 1N potassium hydroxide solution. Subsequently, solutions S-302 and X-302 were added by double jet addition at an accelerating rate (10 times from start to finish) over a period of 41 min. After completing addition, solution G-302 was added and subsequently solutions S-303 and X-303, each 80% thereof were added by double jet addition at an accelerating rate, while the silver potential of the reaction mixture was controlled to 8 mV using 1.0N potassium bromide solution. The temperature of the reaction mixture lowered to 40° C. taking 20 min. Thereafter, the silver potential of the reaction mixture E was adjusted to −32 mV using 1.5N potassium bromide solution. After adding a silver iodide fine grain emulsion with an average grain size of 0.05 μm in an amount equivalent to 0.05 mol, residual solutions S-303 and X-303 were added thereto over a period of 7 min.

| | |
|---|---|
| S-302 | |
| Silver nitrate | 20.60 g |
| $H_2O$ | 92.27 ml |
| X-302 | |
| Potassium bromide | 14.43 g |
| $H_2O$ | 91.77 ml |
| G-302 | |
| Alkali-processed inert gelatin (MW 100,000) | 20.76 g |
| $H_2O$ | 170.7 ml |
| S-303 | |
| Silver nitrate | 577.8 g |
| $H_2O$ | 834.0 ml |
| X-303 | |
| Potassium bromide | 396.7 g |
| Potassium iodide | 11.29 g |
| $H_2O$ | 824.2 ml |

After completing growth. the reaction mixture was desalted to remove soluble salts according to the conventional manner, gelatin was further added thereto to redisperse and the pH and pAg were adjusted to 5.8 and 8.1, respectively. The resulting emulsion was referred to Em-300.

Preparation of Inventive Emulsion Em-400

Nucleation

A gelatin solution (B-401) as shown below was maintained at a temperature of 28° C. with stirring by mixing stirrer described in JP-A 62-160128 at a rotating speed of 450 r.p.m. and the pH was adjusted to 1.95 using 1N sulfuric acid aqueous solution. Thereto were added solutions S-401 and X-401 by double jet addition at a constant flow rate over a period of 1 min. to form nucleus grains.

| | |
|---|---|
| B-401 | |
| Oxidized gelatin (av. M.W. 100.000) | 2.100 g |
| Potassium bromide | 0.932 g |
| $H_2O$ | 839.9 ml |
| S-401 | |
| Silver nitrate | 1.624 g |
| $H_2O$ | 18.747 ml |
| X-401 | |
| Potassium bromide | 1.138 g |
| $H_2O$ | 18.708 ml |

Ripening

After completing addition, a solution G-401 was added thereto and the temperature was raised to 60° C. taking 30 min. The reaction mixture was further held over a period of 20 min., while the silver potential was controlled to 6 mV using 0.5N potassium bromide solution.

| | |
|---|---|
| G-401 | |
| Alkali-processed inert gelatin (MW 100,000) | 4.478 g |
| Compound A (10 wt.% methanol solution) | 2.312 ml |
| $H_2O$ | 103.0 ml |

Growth

After completing ripening, the pH was adjusted to 5.8 using 1N potassium hydroxide solution. Subsequently, solutions S-402 and X-402 were added by double jet addition at an accelerating rate (10 times from start to finish) over a period of 41 min. After completing addition, solution G-402 was added and subsequently solutions S-403 and X-403, each 80% thereof were added by double jet addition at an accelerating rate, while the silver potential of the reaction mixture was controlled to 8 mV using 1.0N potassium bromide solution. The temperature of the reaction mixture lowered to 40° C. taking 20 min. Thereafter, the pAg of the reaction mixture was adjusted to −32 mV using 1.5N potassium bromide solution. After adding a silver iodide fine grain emulsion with an average grain size of 0.05 μm in an amount equivalent to 0.05 mol, residual solutions S-403 and X-403 were added thereto over a period of 7 min.

| | |
|---|---|
| S-402 | |
| Silver nitrate | 20.60 g |
| $H_2O$ | 92.27 ml |
| X-402 | |
| Potassium bromide | 14.43 g |
| $H_2O$ | 91.77 ml |
| G-402 | |
| Alkali-processed inert gelatin (MW 100,000) | 20.76 g |
| $H_2O$ | 170.7 ml |
| S-403 | |
| Silver nitrate | 577.8 g |
| $H_2O$ | 834.0 ml |
| X-403 | |
| Potassium bromide | 396.7 g |
| Potassium iodide | 11.29 g |
| $H_2O$ | 824.2 ml |

After completing growth. the reaction mixture was desalted to remove soluble salts according to the conventional manner, gelatin was further added thereto to redisperse and the pH and pAg were adjusted to 5.8 and 8.1, respectively. The resulting emulsion was referred to Em-400.

Preparation of Comparative Emulsion Em-500

Nucleation

A gelatin solution (B-501) as shown below was maintained at a temperature of 28° C. with stirring by mixing stirrer described in JP-A 62-160128 at a rotating speed of 450 r.p.m. and the pH was adjusted to 1.95 using 1N sulfuric acid aqueous solution. Thereto were added solutions S-501 and X-501 by double jet addition at a constant flow rate over a period of 1 min. to form nucleus grains.

| B-501 | |
|---|---|
| Oxidized gelatin (av. M.W. 100.000) | 2.100 g |
| Potassium bromide | 0.932 g |
| Compound A (10 wt. % methanol solution) | 2.312 ml |
| $H_2O$ | 837.5 ml |
| S-501 | |
| Silver nitrate | 1.624 g |
| $H_2O$ | 18.747 ml |
| X-501 | |
| Potassium bromide | 1.138 g |
| $H_2O$ | 18.708 ml |

Ripening

After completing addition, a solution G-301 was added thereto and the temperature was raised to 60° C. taking 30 min. The reaction mixture was further held over a period of 20 min., while the silver potential was controlled to 6 mV using 0.5N potassium bromide solution.

| G-501 | |
|---|---|
| Alkali-processed inert gelatin (MW 100,000) | 4.478 g |
| $H_2O$ | 105.4 ml |

Growth

After completing ripening, the pH was adjusted to 5.8 using 1N potassium hydroxide solution. Subsequently, solutions S-502 and X-502 were added by double jet addition at an accelerating rate (10 times from start to finish) over a period of 41 min. After completing addition, solution G-502 was added and subsequently solutions S-503 and X-503, each 80% thereof were added by double jet addition at an accelerating rate, while the silver potential of the reaction mixture was controlled to 8 mV using 1.0N potassium bromide solution. The temperature of the reaction mixture lowered to 40° C. taking 20 min. Thereafter, the silver potential of the reaction mixture was adjusted to −32 mV using 1.5N potassium bromide solution. After adding a silver iodide fine grain emulsion with an average grain size of 0.05 μm in an amount equivalent to 0.05 mol, residual solutions S-503 and X-503 were added thereto over a period of 7 min.

| S-502 | |
|---|---|
| Silver nitrate | 20.60 g |
| $H_2O$ | 92.27 ml |
| X-502 | |
| Potassium bromide | 14.43 g |
| $H_2O$ | 91.77 ml |
| G-502 | |
| Alkali-processed inert gelatin (MW 100,000) | 20.76 g |
| $H_2O$ | 170.7 ml |
| S-503 | |
| Silver nitrate | 577.8 g |
| $H_2O$ | 834.0 ml |
| X-503 | |

-continued

| | |
|---|---|
| Potassium bromide | 396.7 g |
| Potassium iodide | 11.29 g |
| $H_2O$ | 824.2 ml |

After completing growth. the reaction mixture was desalted to remove soluble salts according to the conventional manner, gelatin was further added thereto to redisperse and the pH and pAg were adjusted to 5.8 and 8.1, respectively. The resulting emulsion was referred to Em-500.

Preparation of Comparative Emulsion Em-600

Nucleation

A gelatin solution (B-601) as shown below was maintained at a temperature of 28° C. with stirring by mixing stirrer described in JP-A 62-160128 at a rotating speed of 450 r.p.m. and the pH was adjusted to 1.95 using 1N sulfuric acid aqueous solution. Thereto were added solutions S-601 and X-601 by double jet addition at a constant flow rate over a period of 1 min. to form nucleus grains.

| B-601 | |
|---|---|
| Oxidized gelatin (av. M.W. 100.000) | 2.100 g |
| Potassium bromide | 0.932 g |
| $H_2O$ | 839.9 ml |
| S-601 | |
| Silver nitrate | 1.624 g |
| $H_2O$ | 18.747 ml |
| X-601 | |
| Potassium bromide | 1.138 g |
| $H_2O$ | 18.708 ml |

Ripening

After completing addition, a solution G-601 was added thereto and the temperature was raised to 60 C. taking 30 min. The reaction mixture was further held over a period of 20 min., while the silver potential was controlled to 6 mV using 0.5N potassium bromide solution.

| G-601 | |
|---|---|
| Alkali-processed inert gelatin (MW 100,000) | 4.478 g |
| Compound A (10 wt. % methanol solution) | 2.312 ml |
| $H_2O$ | 103.0 ml |

Growth

After completing ripening, the pH was adjusted to 5.8 using 1N potassium hydroxide solution. Subsequently, solutions S-602 and X-602 were added by double jet addition at an accelerating rate (10 times from start to finish) over a period of 41 min. After completing addition, solution G-602 was added and subsequently solutions S-603 and X-603, each 80% thereof were added by double jet addition at an accelerating rate, while the silver potential of the reaction mixture was controlled to 8 mV using 1.0N potassium bromide solution. The temperature of the reaction mixture lowered to 40° C. taking 20 min. Thereafter, the silver potential of the reaction mixture was adjusted to −32 mV using 1.5N potassium bromide solution. After adding a silver iodide fine grain emulsion with an average grain size of 0.05 μm in an amount equivalent to 0.05 mol, residual solutions S-603 and X-603 were added thereto over a period of 7 min.

| | |
|---|---|
| S-602 | |
| Silver nitrate | 20.60 g |
| $H_2O$ | 92.27 ml |
| X-602 | |
| Potassium bromide | 14.43 g |
| $H_2O$ | 91.77 ml |
| G-602 | |
| Alkali-processed inert gelatin (MW 100,000) | 20.76 g |
| $H_2O$ | 170.7 ml |
| S-603 | |
| Silver nitrate | 577.8 g |
| $H_2O$ | 834.0 ml |
| X-603 | |
| Potassium bromide | 396.7 g |
| Potassium iodide | 11.29 g |
| $H_2O$ | 824.2 ml |

After completing growth. the reaction mixture was desalted to remove soluble salts according to the conventional manner, gelatin was further added thereto to redisperse and the pH and pAg were adjusted to 5.8 and 8.1, respectively. The resulting emulsion was referred to Em-600.

Preparation of Comparative Emulsion Em-700

Nucleation

A gelatin solution (B-701) as shown below was maintained at a temperature of 28° C. with stirring by mixing stirrer described in JP-A 62-160128 at a rotating speed of 450 r.p.m. and the pH was adjusted to 1.95 using 1N sulfuric acid aqueous solution. Thereto were added solutions S-701 and X-701 by double jet addition at a constant flow rate over a period of 1 min. to form nucleus grains.

| | |
|---|---|
| B-701 | |
| Oxidized gelatin (av. M.W. 100.000) | 2.100 g |
| Potassium bromide | 0.932 g |
| Compound A (10 wt. % methanol solution) | 1.200 ml |
| $H_2O$ | 838.7 ml |
| S-701 | |
| Silver nitrate | 1.624 g |
| $H_2O$ | 18.747 ml |
| X-701 | |
| Potassium bromide | 1.138 g |
| $H_2O$ | 18.708 ml |

Ripening

After completing addition, a solution G-701 was added thereto and the temperature was raised to 60° C. taking 30 min. The reaction mixture was further held over a period of 20 min., while the silver potential was controlled to 6 mV using 0.5N potassium bromide solution.

| | |
|---|---|
| G-701 | |
| Alkali-processed inert gelatin (MW 100,000) | 4.478 g |
| $H_2O$ | 105.4 ml |

Growth

After completing ripening, the pH was adjusted to 5.8 using 1N potassium hydroxide solution. Subsequently, solutions S-702 and X-702 were added by double jet addition at an accelerating rate (10 times from start to finish) over a period of 38 min. After completing addition, solution G-702 was added and subsequently solutions S-703 and X-703, each 80% thereof were added by double jet addition at an accelerating rate, while the silver potential of the reaction mixture was controlled to 8 mV using 1.0N potassium bromide solution. The temperature of the reaction mixture lowered to 40° C. taking 20 min. Thereafter, the pAg of the reaction mixture was adjusted to −32 mV using 1.5N potassium bromide solution. After adding a silver iodide fine grain emulsion with an average grain size of 0.05 $\mu$m in an amount equivalent to 0.05 mol, residual solutions S-703 and X-703 were added thereto over a period of 7 min.

| | |
|---|---|
| S-702 | |
| Silver nitrate | 20.60 g |
| $H_2O$ | 92.27 ml |
| X-702 | |
| Potassium bromide | 14.43 g |
| $H_2O$ | 91.77 ml |
| G-702 | |
| Alkali-processed inert gelatin (MW 100,000) | 20.76 g |
| $H_2O$ | 170.7 ml |
| S-703 | |
| Silver nitrate | 577.8 g |
| $H_2O$ | 834.0 ml |
| X-703 | |
| Potassium bromide | 396.7 g |
| Potassium iodide | 11.29 g |
| $H_2O$ | 824.2 ml |

After completing growth. the reaction mixture was desalted to remove soluble salts according to the conventional manner, gelatin was further added thereto to redisperse and the pH and pAg were adjusted to 5.8 and 8.1, respectively. The resulting emulsion was referred to Em-700.

Preparation of Inventive Emulsion Em-800

Nucleation

A gelatin solution (B-801) as shown below was maintained at a temperature of 28° C. with stirring by mixing stirrer described in JP-A 62-160128 at a rotating speed of 450 r.p.m. and the pH was adjusted to 1.95 using 1N sulfuric acid aqueous solution. Thereto were added solutions S-801 and X-801 by double jet addition at a constant flow rate over a period of 1 min. to form nucleus grains.

| | |
|---|---|
| B-801 | |
| Oxidized gelatin (av. M.W. 100.000) | 2.100 g |
| Potassium bromide | 0.932 g |
| $H_2O$ | 839.9 ml |
| S-801 | |
| Silver nitrate | 1.624 g |
| $H_2O$ | 18.747 ml |
| X-801 | |
| Potassium bromide | 1.138 g |
| $H_2O$ | 18.708 ml |

Ripening

After completing addition, a solution 8-301 was added thereto and the temperature was raised to 60° C. taking 30 min. The reaction mixture was further held over a period of 20 min., while the silver potential was controlled to 6 mV using 0.5N potassium bromide solution.

| G-801 | |
|---|---|
| Alkali-processed inert gelatin (MW 100,000) | 4.478 g |
| Compound A (10 wt. % methanol solution) | 1.200 ml |
| $H_2O$ | 104.2 ml |

Growth

After completing ripening, the pH was adjusted to 5.8 using 1N potassium hydroxide solution. Subsequently, solutions S-802 and 8-302 were added by double jet addition at an accelerating rate (10 times from start to finish) over a period of 38 min. After completing addition, solution G-802 was added and subsequently solutions S-303 and X-303, each 80% thereof were added by double jet addition at an accelerating rate, while the silver potential of the reaction mixture was controlled to 8 mV using 1.0N potassium bromide solution. The temperature of the reaction mixture lowered to 40° C. taking 20 min. Thereafter, the pAg of the reaction mixture was adjusted to −32 mV using 1.5N potassium bromide solution. After adding a silver iodide fine grain emulsion with an average grain size of 0.05 μm in an amount equivalent to 0.05 mol, residual solutions S-803 and X-803 were added thereto over a period of 7 min.

| S-802 | |
|---|---|
| Silver nitrate | 20.60 g |
| $H_2O$ | 92.27 ml |
| X-802 | |
| Potassium bromide | 14.43 g |
| $H_2O$ | 91.77 ml |
| G-802 | |
| Alkali-processed inert gelatin (MW 100,000) | 20.76 g |
| $H_2O$ | 170.7 ml |
| S-803 | |
| Silver nitrate | 577.8 g |
| $H_2O$ | 834.0 ml |
| X-803 | |
| Potassium bromide | 396.7 g |
| Potassium iodide | 11.29 g |
| $H_2O$ | 824.2 ml |

After completing growth. the reaction mixture was desalted to remove soluble salts according to the conventional manner, gelatin was further added thereto to redisperse and the pH and pAg were adjusted to 5.8 and 8.1, respectively. The resulting emulsion was referred to Em-800.

Preparation of Comparative Emulsion Em-900

Nucleation

A gelatin solution (B-901) as shown below was maintained at a temperature of 28° C. with stirring by mixing stirrer described in JP-A 62-160128 at a rotating speed of 450 r.p.m. and the pH was adjusted to 1.95 using 1N sulfuric acid aqueous solution. Thereto were added solutions S-901 and X-901 by double jet addition at a constant flow rate over a period of 1 min. to form nucleus grains.

| B-901 | |
|---|---|
| Oxidized gelatin (av. M.W. 100.000) | 2.100 g |
| Potassium bromide | 0.932 g |
| $H_2O$ | 839.9 ml |
| S-901 | |
| Silver nitrate | 1.624 g |
| $H_2O$ | 18.747 ml |
| X-901 | |
| Potassium bromide | 1.138 g |
| $H_2O$ | 18.708 ml |

Ripening

After completing addition, a solution G-901 was added thereto and the temperature was raised to 60° C. taking 30 min. The reaction mixture was further held over a period of 20 min., while the silver potential was controlled to 6 mV using 0.5N potassium bromide solution.

| G-901 | |
|---|---|
| Alkali-processed inert gelatin (MW 100,000) | 4.478 g |
| Compound A (10 wt. % methanol solution) | 0.600 ml |
| $H_2O$ | 104.8 ml |

Growth

After completing ripening, the pH was adjusted to 5.8 using 1N potassium hydroxide solution. Subsequently, solutions S-902 and X-902 were added by double jet addition at an accelerating rate (10 times from start to finish) over a period of 37 min. After completing addition, solution G-902 was added and subsequently solutions S-903 and X-903, each 80% thereof were added by double jet addition at an accelerating rate, while the silver potential of the reaction mixture was controlled to 8 mV using 1.0N potassium bromide solution. The temperature of the reaction mixture lowered to 40° C. taking 20 min. and then the silver potential of the reaction mixture was adjusted to −32 mV using 1.5N potassium bromide solution. After adding a silver iodide fine grain emulsion with an average grain size of 0.05 μm in an amount equivalent to 0.05 mol, residual solutions S-903 and X-903 were added thereto over a period of 7 min.

| S-902 | |
|---|---|
| Silver nitrate | 20.60 g |
| $H_2O$ | 92.27 ml |
| X-902 | |
| Potassium bromide | 14.43 g |
| $H_2O$ | 91.77 ml |
| G-902 | |
| Alkali-processed inert gelatin (MW 100,000) | 20.76 g |
| Compound A (10 wt. % methanol solution) | 0.60 ml |
| $H_2O$ | 170.1 ml |
| S-903 | |
| Silver nitrate | 577.8 g |
| $H_2O$ | 834.0 ml |
| X-903 | |
| Potassium bromide | 396.7 g |
| Potassium iodide | 11.29 g |
| $H_2O$ | 824.2 ml |

After completing growth. the reaction mixture was desalted to remove soluble salts according to the conventional manner, gelatin was further added thereto to redisperse and the pH and pAg were adjusted to 5.8 and 8.1, respectively. From the resulting emulsion which was referred to Em-900, it was shown that an average iodide content of the surface phase was 7.2 mol %, 91% of the total grain projected area being accounted for by silver halide grains each having 10 or more dislocation lines and a variation coefficient of the iodide content of grains being 14%.

Characteristics of thus-prepared silver halide emulsions are summarized in Table 1, icluding grain form, average aspect ratio, average grain size (μm), variation coefficient of grain size (%), grain thickness (mm), variation coefficient of grain thickness (%), and proportion of grains having dislocation lines, based on grain projected area.

TABLE 1

| Emulsion | Grain form | Aspect ratio | Grain size (μm) | Var. coef. of grain size (%) | Grain thickness | Var. coef. of thickness (%) | Proportion of dislocation grain (%) |
|---|---|---|---|---|---|---|---|
| Em-100 (Comp.) | H.T.* | 3.7 | 0.96 | 8.3 | 0.299 | 23.4 | 0.0 |
| Em-200 (Comp.) | H.T. | 3.5 | 0.97 | 9.8 | 0.293 | 15.8 | 0.0 |
| Em-300 (Comp.) | H.T. | 3.7 | 0.97 | 8.6 | 0.295 | 24.9 | 86.2 |
| Em-400 (Inv.) | H.T. | 3.6 | 0.99 | 8.9 | 0.282 | 17.9 | 85.1 |
| Em-500 (Comp.) | H.T. | 2.8 | 0.91 | 8.6 | 0.336 | 25.2 | 76.5 |
| Em-600 (Comp.) | H.T. | 2.9 | 0.92 | 9.3 | 0.327 | 18.4 | 77.9 |
| Em-700 (Comp.) | H.T. | 6.7 | 1.21 | 8.7 | 0.190 | 22.1 | 94.4 |
| Em-800 (Inv.) | H.T. | 6.4 | 1.19 | 8.4 | 0.193 | 17.3 | 93.2 |
| Em-900 (Inv.) | H.T. | 6.6 | 1.21 | 8.9 | 0.187 | 14.4 | 97.3 |
| Em-905 (Comp.) | H.T. | 6.9 | 1.18 | 26.0 | 0.199 | 18.7 | 91.8 |
| Em-405 (Comp.) | H.T. | 3.8 | 0.93 | 23.0 | 0.224 | 16.5 | 92.1 |

*H.T.: Hexagonal tabular grain

In the Table, the area ratio of dislocation line containing grains is referred to (sum of projected area of dislocation line containing grains/total grain projected are)×100 (%). Preparation of photographic material samples 100 to 900

To each of silver halide emulsion EM-100 to 900 with keeping at a temperature of 52° C. were added spectral sensitizing dyes SSD-1, SSD-2 and SSD-3. After ripening over a period of 20 min., sodium thiosulfate was added and chloroauric acid and potassium thiocyanate were further added to carry out ripening so as to obtain optimal sensitivity-fog relationship. after completing ripening, 1-phenyl-5-mercaptotetrazole and 4-hydroxy-6-methyl-1,3, 3a,7-tetrazaindene were added thereto to stabilize the emulsion. The addition amount of the sensitizing dye, sensitizer or stabilizer to each emulsion and the ripening time were designed so as to give an optimal sensitivity-for relationship when exposed for 1/2000 sec.

The following coupler MCP-1 was dissolved in ethyl acetate and Tricresyl phosphate and the resulting solution was dispersed in an aqueous gelatin solution to prepare a coupler dispersion. To each of sensitized silver halide emulsions Em-100 through 900 were added the above coupler dispersion and conventional adjuvants such as a coating aid and hardener o to prepare a coating solution. Each coating solution was coated on a subbed triacetyl cellulose film support and dried according to the conventional method to prepare photographic material Samples 100 through 900.

SSD-1

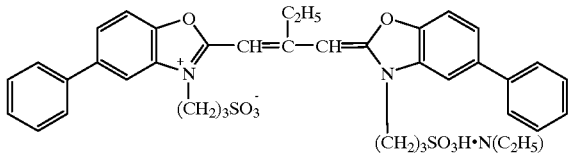

-continued

SSD-2

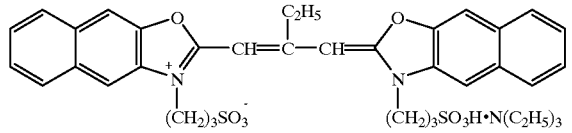

SSD-3

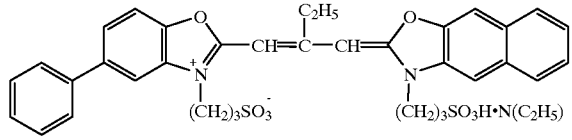

MCP-1

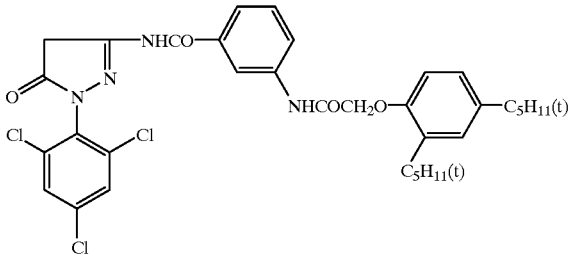

Fresh samples obtained immediately after being prepared each were subjected to wedge-exposure to light with a color temperature of 5400K through a glass filter Y-48 (product by Toshiba) and processing according to the following steps. Further, to evaluate the samples with respect to pressure resistance, after the samples were allowed to stand under the condition at 23° C. and 555 RH for 24 hrs, the surface of each sample was scanned with a needle having 0.025 mm of a curvature radius of its top under load of 5 g at a constant speed using a scratch resistance tester (product by Shintoh Kagaku) and the resulting sample was also processed. Furthermore, to evaluate storage stability, the samples were subjected to accelerated aging test (i.e., aged at 40° C. and 80% RH for 14 days) and processed.

Processing:

| Processing step | Time | Temperature | Replenishing rate* |
|---|---|---|---|
| Color developing | 3 min. 15 sec. | 38 ± 0.3° C. | 780 ml |
| Bleaching | 45 sec. | 38 ± 2.0° C. | 150 ml |
| Fixing | 1 min. 30 sec. | 38 ± 2.0° C. | 830 ml |
| Stabilizing | 1 min. | 38 ± 5.0° C. | 830 ml |
| Drying | 1 min. | 55 ± 5.0° C. | — |

*: Amounts per $m^2$ of photographic material

A color developer, bleach, fixer and stabilizer each were prepared according to the following formulas.

Color developer and replenisher thereof:

| | Worker | Replenisher |
|---|---|---|
| Water | 800 ml | 800 ml |
| Potassium carbonate | 30 g | 35 g |
| Sodium hydrogen carbonate | 2.5 g | 3.0 g |
| Potassium sulfite | 3.0 g | 5.0 g |
| Sodium bromide | 1.3 g | 0.4 g |
| Potassium iodide | 1.2 mg | — |
| Hydroxylamine sulfate | 2.5 g | 3.1 g |
| 4-Amino-3-methyl-N-(β-hydroxyethyl)-aniline sulfate | 4.5 g | 6.3 g |
| Diethylenetriaminepentaacetic acid | 3.0 g | 3.0 g |
| Potassium hydroxide | 1.2 g | 2.0 g |

Water was added to make 1 liter in total, and the pH of the developer and replenisher thereof were each adjusted to 10.06 and 10.18, respectively with potassium hydroxide and sulfuric acid.

Bleach and replenisher thereof:

| | Worker | Replenisher |
|---|---|---|
| Water | 700 ml | 700 ml |
| Ammonium iron (III) 1,3-diamino-propanetetraacetic acid | 125 g | 175 g |
| Ethylenediaminetetraacetic acid | 2 g | 2 g |
| Sodium nitrate | 40 g | 50 g |
| Ammonium bromide | 150 g | 200 g |
| Glacial acetic acid | 40 g | 56 g |

Water was added to make 1 liter in total and the pH of the bleach and replenisher thereof were adjusted to 4.4 and 4.0, respectively, with ammoniacal water or glacial acetic acid.

Fixer and replenisher thereof:

| | Worker | Replenisher |
|---|---|---|
| Water | 800 ml | 800 ml |
| Ammonium thiocyanate | 120 g | 150 g |
| Ammonium thiosulfate | 150 g | 180 g |
| Sodium sulfite | 15 g | 20 g |

-continued

| | Worker | Replenisher |
|---|---|---|
| Ethylenediaminetetraacetic acid | 2 g | 2 g |

Water was added to make 1 liter in total and the pH of the fixer and replenisher thereof were adjusted to 6.2 and 6.5, respectively, with ammoniacal water or glacial acetic acid.

Stabilizer and replenisher thereof:

| | |
|---|---|
| Water | 900 ml |
| p-Octylphenol/ethyleneoxide (10 mol) adduct | 2.0 g |
| Dimethylolurea | 0.5 g |
| Hexamethylenetetramine | 0.2 g |
| 1,2-benzoisothiazoline-3-one | 0.1 g |
| Siloxane (L-77, product by UCC) | 0.1 g |
| Ammoniacal water | 0.5 ml |

Water was added to make 1 liter in total and the pH thereof was adjusted to 8.5 with ammoniacal water or sulfuric acid (50%).

Processed samples each were sensitometrically measured with green light, with respect to sensitivity and fog. Aged samples were also measured with respect to sensitivity and fog and compared with fresh samples. A measuring method and conditions thereof are as follows.

Sensitivity was represented as a reciprocal of exposure that gives a density of a minimum density (Dmin) plus 0.2 and shown as a relative value, based on the sensitivity of Sample 100 being 100 (i.e., a larger value means a higher sensitivity).

Fog was represented as a density at an unexposed portion (Dmin) and shown as a relative value, based on the sensitivity of Sample 100 being 100 (i.e., a smaller value means a lower fog).

An increase of fog due to applied pressure (i.e., pressure fog) was represented as a density increase at an unexposed and load-applied portion and shown as a relative value (ΔDp1l), based on the density increase of Sample 100 being 100 (i.e., a smaller value means a smaller fog increase due to pressure).

A lowering of sensitivity due to applied pressure was represented as a density decrease at a load-applied portion having had a density of (Dmax−Dmin)/2 and shown as a relative value (ΔDp2), based on the density lowering of sample 100 being 100 (i.e., smaller value means a smaller lowering of sensitivity due to pressure).

ΔS represents a ratio of sensitivity of an aged sample after subjected to the accelerated aging test to that of a fresh sample immediately after being prepared (i.e., ΔS=sensitivity of aged sample/sensitivity of fresh sample×100). The value is the closer to 100, sensitivity variation on storage is the smaller.

ΔF represents a ratio of Dmin of an aged sample after subjected to the accelerated aging test to that of a fresh sample immediately after being prepared (i.e., ΔF=Dmin of aged sample/Dmin of fresh sample×100). The value is the closer to 100, fog variation on storage is the smaller.

Results thereof are shown in Table 2.

TABLE 2

| Sample No. | Emulsion | Sensitivity | Fog | ΔDp1 | ΔDp2 | ΔS | ΔF | Remark |
|---|---|---|---|---|---|---|---|---|
| No. 100 | Em-100 | 100 | 100 | 100 | 100 | 75 | 132 | Comp. |
| No. 200 | Em-200 | 105 | 94 | 99 | 100 | 90 | 114 | Comp. |
| No. 300 | Em-300 | 112 | 101 | 84 | 123 | 77 | 135 | Comp. |
| No. 400 | Em-400 | 118 | 93 | 79 | 110 | 91 | 110 | Inv. |
| No. 500 | Em-500 | 110 | 100 | 88 | 119 | 79 | 130 | Comp. |
| No. 600 | Em-600 | 112 | 99 | 87 | 115 | 81 | 126 | Comp. |
| No. 700 | Em-700 | 120 | 99 | 86 | 128 | 75 | 131 | Comp. |
| No. 800 | Em-800 | 127 | 90 | 76 | 108 | 94 | 107 | Inv. |
| No. 900 | Em-900 | 132 | 87 | 75 | 104 | 98 | 102 | Inv. |
| No. 905 | Em-905 | 124 | 90 | 85 | 113 | 80 | 113 | Comp. |
| No. 405 | Em-405 | 113 | 98 | 87 | 118 | 83 | 121 | Comp. |

From characteristics silver halide emulsions as shown in Table 5 and evaluation results as shown in Table 6, it is proved as follows.

From comparison of Samples 100 to 400, it is proved that 1) introduction of dislocation lines into the tabular silver halide grains results enhancement of sensitivity and improvement in pressure fog, but leads to marked lowering of sensitivity due to pressure;
2) higher sensitivity, lower fog and improved storage stability can be achieved by making variation coefficients of grain size and thickness of the tabular grains both not more than 20%;
3) pressure desensitization of the tabular grains having dislocation lines can be improved by making the variation coefficient of grain thickness not more than 20%.

From comparison of Sample 300 to 600, it is proved that 4) the tabular grains with an average aspect ratio of less than 3.0 do not lead to advantageous effects, as in above 2) and 3).

Accordingly, it is proved that the object of the invention of providing a silver halide emulsion superior in sensitivity and fog and improved in storage stability and pressure resistance and a silver halide photographic light sensitive material employing such emulsion is accomplished by tabular silver halide grains having an average aspect ratio of not less than 3.0 and dislocation lines, of which variation coefficients of grain size and thickness both are 20% or less.

Furthermore, from comparison of Samples 300 to 400 and Samples 700 to 900, the object of the invention is further markedly accomplished by the tabular silver halide grains having an average aspect ratio of not less than 6.0 and a variation coefficient of not more than 15%.

What is claimed is:

1. A silver halide photographic emulsion comprising silver halide grains, said silver halide grains consisting essentially of tabular silver halide grains having an average aspect ratio of 3.0 or more, said tabular grains substantially having dislocation lines, a variation coefficient of grain size of said tabular grains being 20% or less and a variation coefficient of thickness of said tabular grains being 20% or less.

2. The silver halide emulsion of claim 1, wherein the average aspect ratio of said tabular grains is 6.0 or more.

3. The silver halide emulsion of claim 1, wherein said tabular grains having dislocation lines account for at least 50% of the total grain projected area.

4. The silver halide emulsion of claim 1, said tabular grains being prepared by a process comprising the steps of (i) forming nucleus grains, (ii) ripening the nucleus grains formed and (iii) growing the nucleus grains to form tabular grains, wherein after completing the step of (i), a compound represented by the following formula (I) is added thereto and ripening or grain growth is carried out in the presence of the compound:

$$YO(CH_2CH_2O)m(CH(CH_3)CH_2O)p(CH_2CH_2O)nY \qquad \text{formula (I)}$$

wherein Y represents a hydrogen atom, —$SO_3M$ or —COBCOOM, in which M represents a hydrogen atom, an alkali metal atom, an ammonium group or ammonium group substituted by an alkyl group having 5 or less carbon atoms and B represents a chained or cyclic linkage group; n and m each are an integer of 0 to 50; p is an integer of 1 to 100.

5. The silver halide emulsion of claim 1, wherein the variation coefficient of thickness of said tabular grains is 15% or less.

6. The silver halide photographic material of claim 1 wherein a variation coefficient of iodide content of the silver halide emulsion is 300 or less.

7. The sliver halide photographic material of claim 6 wherein the variation coefficient of iodide content of the silver halide emulsion is 20% or less.

8. The silver halide photographic emulsion of claim 1, wherein each said silver halide grains further comprises a surface phase which contains at least 1 mol % of silver iodide.

9. The silver halide photographic emulsion of claim 8, wherein each said surface phase contains 2 to 20 mol % of silver iodide.

10. The silver halide photographic emulsion of claim 9, wherein each said surface phase contains 3 to 15 mol % of silver iodide.

11. The silver halide emulsion of claim 9, wherein the average aspect ratio of said tabular grains is 6.0 or more, said tabular grains having dislocation lines account for at least 50% of the total grain projected area, and the variation coefficient of thickness of said tabular grains is 15% or less.

12. The silver halide emulsion of claim 1, wherein the silver halide grains are silver iodobromide containing 1.0 mol % or more iodide.

13. The silver halide emulsion of claim 1, wherein an average iodide content of the silver halide emulsion is 10 mol % or less.

14. The silver halide emulsion of claim 13, wherein the average iodide content is 1.0 to 6.0 mol %.

15. A silver halide photographic light sensitive material comprising a support provided thereon a silver halide emulsion layer comprising a silver halide emulsion containing silver halide grains, wherein said silver halide grains consists essentially of tabular silver halide grains having an average aspect ratio of 3.0 or more, said tabular grains substantially having dislocation lines, a variation coefficient of grain size of said tabular grains being 20% or less and a variation coefficient of thickness of said tabular grains being 20% or less.

16. The silver halide photographic material of claim 15, wherein the average aspect ratio of said tabular grains is 6.0 or more.

17. The silver halide photographic material of claim 15, wherein said tabular grains having dislocation lines account for at least 50% of the total grain projected area.

18. The silver halide photographic material of claim 15, said tabular grains being prepared by a process comprising the steps of (i) forming nucleus grains, (ii) ripening the nucleus grains formed and (iii) growing the nucleus grains to form tabular grains, wherein after completing the step of (i), a compound represented by the following formula (I) is added thereto and ripening or grain growth is carried out in the presence of the compound:

$$YO(CH_2CH_2O)m(CH(CH_3)CH_2O)p(CH_2CH_2O)nY \qquad \text{formula (I)}$$

wherein Y represents a hydrogen atom, —SO3M or —COBCOOM, in which M represents a hydrogen atom, an alkali metal atom, an ammonium group or ammonium group substituted by an alkyl group having 5 or less carbon atoms and B represents a chained or cyclic linkage group; n and m each are an integer of 0 to 50; p is an integer of 1 to 100.

19. The silver halide photographic material of claim 15, wherein the variation coefficient of thickness of said tabular grains is 15% or less.

* * * * *